US008997834B2

(12) United States Patent
Herrmann et al.

(10) Patent No.: US 8,997,834 B2
(45) Date of Patent: Apr. 7, 2015

(54) METHOD FOR PRODUCING OF HOLLOW DIE CAST PRODUCTS

(71) Applicant: MAGNA BDW Technologies GmbH, Markt Schwaben (DE)

(72) Inventors: Christian Herrmann, München (DE); Holger Angermeier, Taufkirchen/Vils (DE); Georg Willnhammer, Maitenbeth (DE)

(73) Assignee: MAGNA BDW Technologies GmbH, Markt Schwaben (DE)

( * ) Notice: Subject to any disclaimer, the term of this patent is extended or adjusted under 35 U.S.C. 154(b) by 0 days.

(21) Appl. No.: 13/758,124

(22) Filed: Feb. 4, 2013

(65) Prior Publication Data

US 2014/0041823 A1 Feb. 13, 2014

(30) Foreign Application Priority Data

Feb. 3, 2012 (DE) ..... 10 2012 100 900

(51) Int. Cl.

*B22D 17/00* (2006.01)
*B22D 17/22* (2006.01)
*B22D 17/26* (2006.01)

(52) U.S. Cl.

CPC ..... *B22D 17/00* (2013.01); *B22D 17/22* (2013.01); *B22D 17/2227* (2013.01); *B22D 17/263* (2013.01)

(58) Field of Classification Search

CPC .... B22D 17/00; B22D 17/22; B22D 17/2227; B22D 17/263
USPC ..... 164/113, 137, 340, 341, 342
See application file for complete search history.

(56) References Cited

U.S. PATENT DOCUMENTS

| | | | | |
|---|---|---|---|---|
| 4,832,110 | A * | 5/1989 | Perrella et al. | 164/316 |
| 6,334,479 | B1 * | 1/2002 | Pollak et al. | 164/457 |
| 6,609,554 | B2 * | 8/2003 | Pollak et al. | 164/312 |
| 6,634,411 | B2 * | 10/2003 | Hirano et al. | 164/72 |
| 6,761,208 | B2 * | 7/2004 | Whealy et al. | 164/340 |
| 6,808,006 | B2 * | 10/2004 | Maesaka et al. | 164/132 |

FOREIGN PATENT DOCUMENTS

| | | | |
|---|---|---|---|
| DE | 824 378 | B | 12/1951 |
| DE | 840 905 | B | 6/1952 |
| DE | 196 39 053 | A1 | 3/1998 |
| DE | 102 61 031 | A1 | 7/2003 |

* cited by examiner

*Primary Examiner* — Kevin P Kerns
(74) *Attorney, Agent, or Firm* — Jordan IP Law, LLC; Todd A. Vaughn

(57) ABSTRACT

A method for the production of a hollow body from die casting aluminum in a die casting machine with a die casting die having mould parts with a stationary mould part and with at least two movable mould parts. The movable mould parts are guided in at least one further movable mould part of the die, so that, in the closed position of the die, the movable mould parts are blocked at least by way of an interlock which is attached to the stationary mould part.

9 Claims, 4 Drawing Sheets

METHOD FOR PRODUCING OF HOLLOW DIE CAST PRODUCTS

CROSS-REFERENCE TO RELATED APPLICATIONS

The present application claims priority under 35 U.S.C. §119 to German Patent Application No. DE 10 2012 100 900.7 (filed on Feb. 3, 2012), which is hereby incorporated by reference in its entirety.

TECHNICAL FIELD

Embodiments are directed to a method for the production of hollow aluminium die castings, such as cylindrical hollow bodies having precise structures.

BACKGROUND

Aluminium die castings are assuming increasing importance in the automobile industry. The requirement to build lighter vehicles results in the expanded use of aluminium parts. Particularly where moved parts are concerned, it is advantageous to save weight, while at the same time having high stability. Components can be produced with small wall thicknesses by aluminium die casting.

Use of aluminium die casting for highly stressed components, however, also requires a set of production measures, some of which are already known. These are, in particular, blocking of displaceable tool parts and also sealing of displaceable tool parts with respect to one another, which are discussed in various versions in the prior art.

As illustrated in FIG. 1, die casting machines 1 for aluminium die casting, include essentially two main subassemblies: the mould-closing unit 2 and the casting unit 3. Further subassemblies are the ejection unit, the core-pulling device and the machine drive, including control.

The mould-closing unit 2 makes it possible to open and close the mould halves and lock them during casting, so that the closing force acts upon the mould. The most important components are a fixed chucking plate 4 for taking up the stationary mould half, a movable chucking plate 6 for receiving the movable mould half, machine columns 5 for guiding the movable chucking plate 6. The mould-closing unit is driven, in all die casting machines, by means of a hydraulic closing cylinder.

The casting unit 3 of a die casting machine has the task of conveying liquid metal into the die casting mould and of generating sufficient pressure upon the solidifying metal. The ejection unit 7 serves for removing the casting from the mould part and is installed in the movable chucking plate. The core-pulling device serves for the actuation of core cylinders on the die casting mould. They operate hydraulically and make it possible to introduce and release movable cores.

An important component of the die casting machine is the die casting mould, the inner space of which is identical to the contours and dimensions of the casting to be cast. Each die casting mould is made of at least two parts, so that the casting can be removed from the mould cavity after solidification.

Each die casting mould include a fixed and of at least one movable mould half. The fixed mould half is mounted on the fixed chucking plate of the die casting machine, while the movable moulding half is fastened to the movable chucking plate. The contact surfaces of the mould halves are designated as parting planes. Their position inside the mould is determined by the shape of the casting and the type of removal from the mould. The parting is designed such that a simple construction of the mould is made possible and the deburring of the casting is assisted. To avoid splashes of liquid metal, the mould parting plane has to be satisfactorily sealed off. In order to make it possible to fit the two mould halves together exactly, die casting moulds have to be provided with guides for the opening and closing movement. Movable cores are inserted for the purpose of forming bores, clearances, perforations, projecting surfaces, webs or ribs which do not run in the mould-closing direction.

DE 10 2007 017972 discloses a plastic injection-moulding die, the casing of which is supported geometrically against recesses. A type of blocking in this case takes place. This die, however, is not capable of managing the high pressures of aluminium die casting.

A solution to the problem of having to seal off the parting planes is found in DE 1963 9053, which discloses stepped contact points between die casting die parts. This embodiment, however, cannot fulfil the requirement as to the leak tightness and guidance of the die parts.

SUMMARY

In accordance with embodiments, an optimized production method is provided for a hollow component, in which it is possible to cast the hollow component with precision and quality which are unusable for aluminium die casting.

Embodiments are related to a method of producing a hollow body from die cast aluminium, the method including providing a die casting machine with a die casting die that includes a stationary mould part and at a plurality of movable mould parts, the movable mould parts being guided in at least one additional second movable mould part of the die, the movable mould parts combining with corner battens to form a space in which a third movable mould part is introduced; moving the movable mould parts and the corner battens together; forming a seal which is of at least single-stage form, such that in a closed position of the die, the movable mould parts are blocked at least by an interlock which is attached to the stationary mould part.

To produce a hollow body from die cast aluminium, it is advantageous to use a die casting machine with a die casting die that includes mould parts with a stationary mould part and with at least two movable mould parts. The movable mould parts are guided in at least one further, movable mould part of the die, so that in the closed position of the die the movable mould parts are blocked at least by, means of an interlock is attached to the stationary mould part.

For an enhanced distribution of the interlocking forces, the interlocks are in each case arranged in pairs, in order to block a movable mould part in the closed state. It is advantageous for reliable interlocking in this case that the interlocks have in each case their outer surface in alignment with the outer surface of the movable mould part.

Advantageously, the interlocks have an oblique surface in the direction of the centre of the die, so that it becomes simpler to guide the individual parts of the die together.

Advantageously, the seals are formed as a result of a stepped configuration of movable mould parts and corner battens, which, furthermore, also permits highly precise guidance of the movable parts with respect to one another.

It is advantageous, furthermore, if the hollow body is injected such that no disturbing burrs are present in the useful region of the component, this being made possible by the use of a sealing ring for the core.

DRAWINGS

Exemplary embodiments of the invention will be discussed in principle below on the basis of the drawings, in which.

DESCRIPTION

Figure 1:
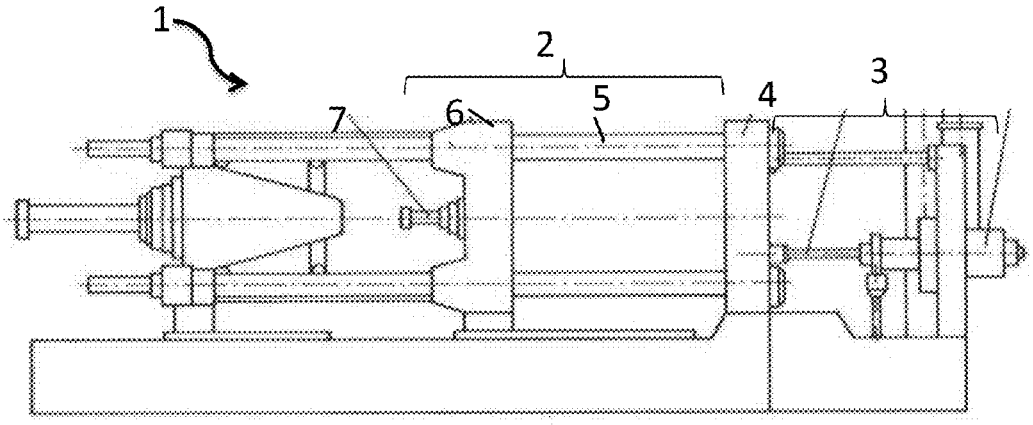
FIG. 1 illustrates a diagrammatic die casting machine.
Figure 2:
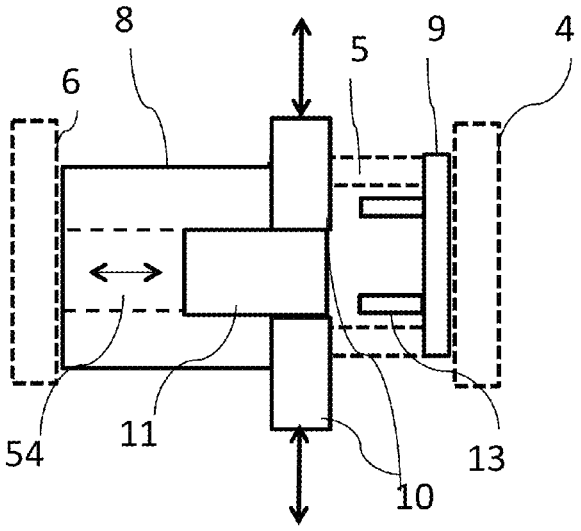
FIG. 2 illustrates a diagram of a die casting die.

FIG. 2 illustrates diagrammatically the set-up of a die in a die casting machine that includes a pair of chucking plates of the machine: a fixed chucking plate 4 and a movable chucking plate 6, which are depicted by dashes. The die casting die is formed on the stationary side by a fixed mould part 9. On the movable side, the movable mould part 8 forms the guide for further movable mould parts 10. These movable mould parts 10 form slides which are arranged so as to be displaceable from the centre of the movable mould part 8. The movable mould parts 10, slides, are designed correspondingly to the outer contour of the hollow body to be cast. If the component is in this case symmetrical, at least two slides, but even three or four slides, are possible. In accordance with a preferred embodiment, a mould has four movable mould parts 10 which are attached symmetrically crosswise on the movable mould part 8.

When the mould halves are being moved together, the movable mould parts 10 are pressed against the interlock 13 of the fixed mould halves and are confined by the corner battens 60 such that they cannot move too far into the mould. In this case, the composite assembly composed of movable mould parts 10 and of the multi-stage corner battens 60 serves for splash protection and for sealing-off. A core 11 which is pushed into the die serves for producing the hollow inner shape.

After the removal of a cast component from the mould, in the first step, the core 11 is moved into the mould. Subsequently, the movable mould parts 10 are displaced in the direction of the centre of the movable mould plate 8. The mould is then closed by the movable mould plate 8 being pressed against the fixed mould plate 9. The liquid metal is pressed into the mould via a casting orifice. After the conclusion of the casting operation, removal from the mould takes place, and all the movable parts, first the movable mould plate 8 with the movable mould parts 10 and the slides, and then the core 11, are moved into the opening position, and the hollow body can be removed.

Figure 3:
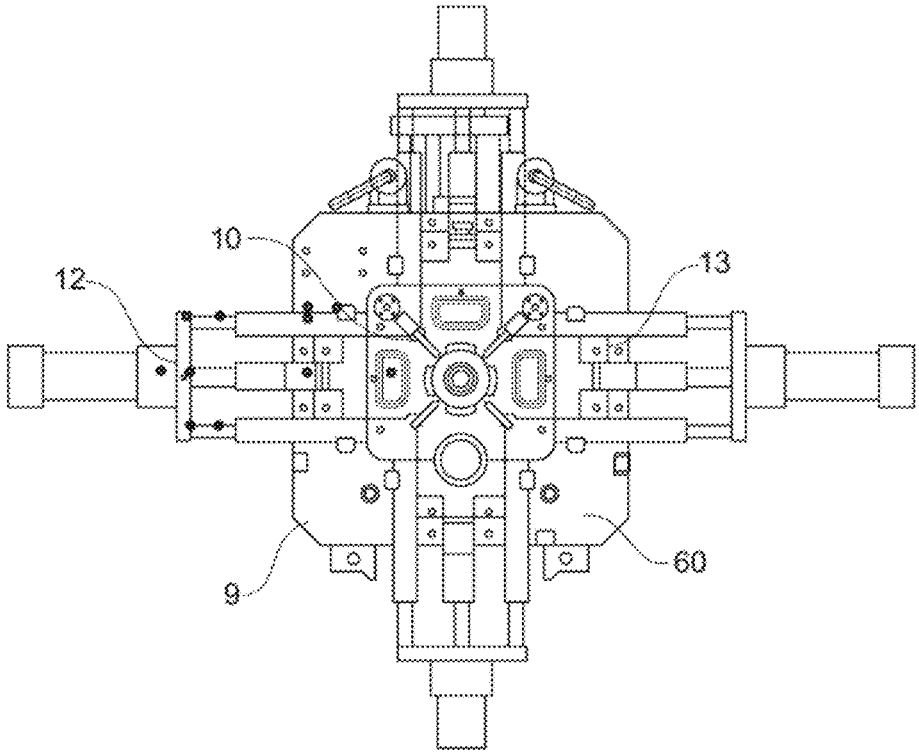
FIG. 3 illustrates the top view of a closed die casting die.

FIG. 3 illustrates the die in greater detail, the view being along the longitudinal axis of the die casting machine. In this view, the stationary mould part 9 forms the base and, built on this, four corner battens 60 with movable mould parts or slides 10 lying between them and arranged crosswise can be seen. The movable mould parts 10 are moved in each case by hydraulic cylinders along the respective longitudinal axes. In this case, the movable mould parts 10 are pushed between the corner battens 60. Furthermore, interlocks 13 can be seen which are illustrated more clearly in FIG. 4.

Figure 4:
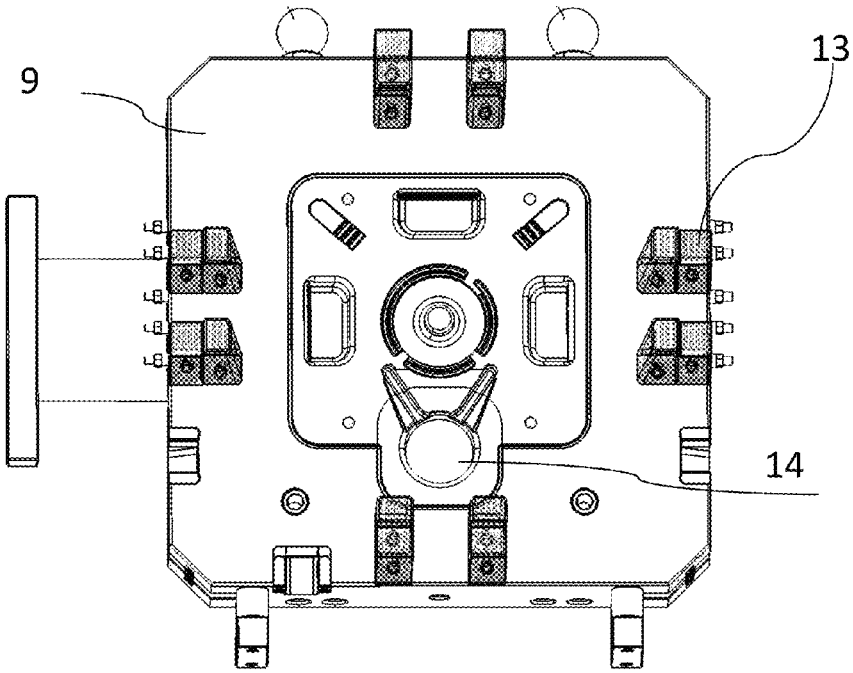
FIG. 4 illustrates the top view of a stationary mould plate.

FIG. 4 illustrates the stationary mould part 9 with the casting orifice 14 in the lower region. The interlocks 13 are connected firmly to the stationary mould plate 9. In the chosen embodiment, they are arranged crosswise correspondingly to the movable mould parts, i.e., the slides 10. The interlock 13 thus in each case forms a pair for each side of the stationary mould part 9. It is thereby possible that one of the hydraulic cylinders 12 engages centrally on the movable mould part 10, and the two further cylinders 12 are guided along on both sides of the pair of interlocks. Force is thereby distributed uniformly upon the movable mould part 10. Moreover, the use of two interlocks 13 arranged symmetrically with respect to the mid-axis of the movable mould part makes it possible to interlock the movable mould part at its two end points and thus hinder any tilting out of place.

The interlocks 13 have a slope on their flank directed inwards towards the centre. This slope serves the purpose that the mould parts of the die can be pushed one into the other more easily and the actual blocking of movement takes place only on the planes of the stationary mould part when the movable mould parts 8, together with the movable mould parts 10, are pressed against the stationary mould part 9. The interlock 13 thus serves as a stop for the movable mould parts, slides 10, so that not only the hydraulic cylinders 12 of the machine absorb the casting pressure, but also the stationary part of the die itself. It is consequently possible to produce fine structures of the component and to minimize the play in the die.

The interlock 13 is described as one embodiment. It is also possible, however, to use only one interlocking component 13 and to arrange the hydraulic cylinders 12 in a different manner.

Figure 5:
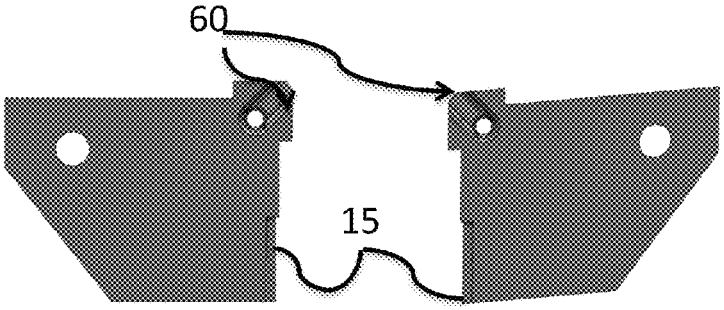
FIG. 5 illustrates a version of a corner batten.
Figure 6:
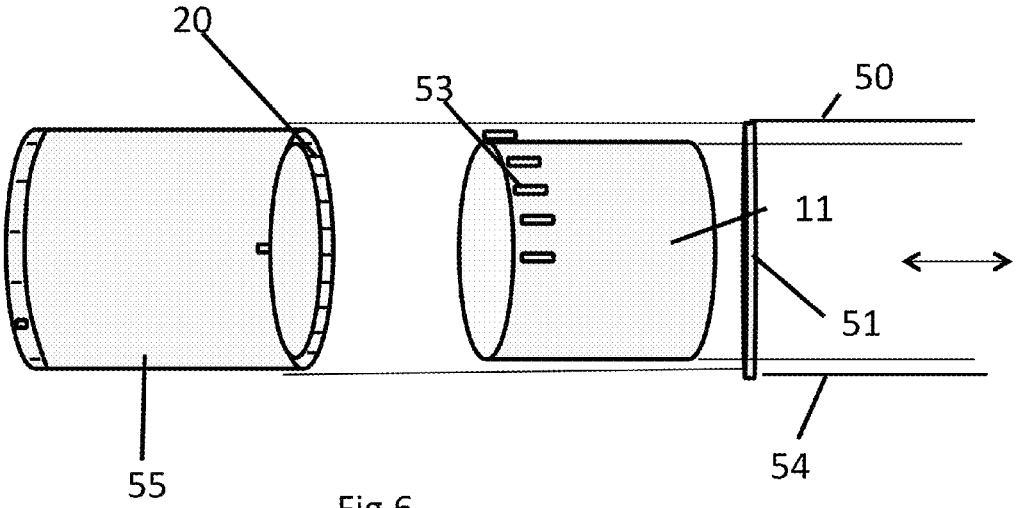
FIG. 6 illustrates a core.

A further aspect of the production method is found in FIG. 5. Here, for example, one of the corner battens 60 illustrated in FIG. 3 is removed. The corner battens 60 are arranged in the four corners of the movable mould part 8. The movable mould parts 10 have to be introduced into the orifices between the columns. The corner battens 60 and the movable mould parts 10 have stepped terminations 15. They form a multi-stage seal which prevents material from escaping under pressure at the joints of the die. This multi-stage seal at corner battens 60 and movable mould parts also serves at the same time for the reliable and precise positioning of the movable parts with respect to one another.

A further sealing problem which also has an effect on the precision of the component is solved with regard to the core 11 of the die.

Assuming a cylindrical embodiment, a cylindrical core 11 is used. The cylindrical core 11 has a plurality of teeth on an outer surface thereof. By way of the teeth 53 of the core 11, structures are likewise formed on the component 55 and are obtained as unfinished casting points 20 for the further use of the component 55. Since the cylinder is cast around a middle core, the configuration of the middle core or of its guide bush 50 in the movable mould part 8 assumes a particular function. In this case, it is appropriate to avoid problems in the high-precision component 55 which are caused by cast-in burrs and accumulations of impurities which are unavoidable in casting terms. This is achieved by subdividing the guide bush 50 into a first portion approximately 20 mm thick, what is known as the sealing ring 51, and a second portion 54 of the guide 50.

The play between the sealing ring 51 and the middle core is acceptable at H7/g6 and is therefore reduced to a minimum, so that aluminium is prevented from being injected into the gap between the middle core and guide 50 during die casting. The parting point between the middle core and the sealing ring 51 lies so far to the outside that the residual burr possibly occurring lies within the machining allowance of the unfinished part and can be removed later in the machining process.

The play between the guide bush 50 and the core 11 is acceptable at 0.3 mm, thus ensuring that the middle core is pulled forwards and backwards reliably during the process. The diagram indicates teeth 53 which are formed by the core 11 in the finished component 55. These are, in one embodiment, toothed rings 53 which are cast with high accuracy. Since the toothed rings 53 are not remachined, this precision is of major importance.

It is possible by way of the production steps to produce an especially precise hollow component by aluminium die casting.

Although embodiments have been described herein, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of producing a hollow body from die cast aluminium, the method comprising:

providing a die casting machine with a casting die that includes a stationary mould plate and a movable mould plate having a plurality of movable mould parts which correspond to an outer contour of the hollow body to be cast and which are movable from a centre of the movable mould plate, the movable mould parts being guided in at least one additional second movable mould part of the die, the movable mould parts combining with corner battens to form a space in which a third movable mould part is introduced;

moving the movable mould parts and the corner battens together;

forming a seal which is of at least single-stage form, such that in a closed position of the die, the movable mould parts are blocked at least by interlocks which are attached to the stationary mould plate.

2. The method of claim 1, wherein the interlocks block one of the movable mould parts in the closed position.

3. The method of claim 1, wherein the interlocks are blocked by having their respective outer surfaces in alignment with the outer surface of the movable mould plate.

4. The method of claim 1, wherein the interlocks are blocked by having an oblique surface in a direction of the centre of the die.

5. The method of claim 1, further comprising pulling a core via a guide bush which has a sealing ring, the core serving to produce the hollow inner shape of the hollow body.

6. The method of claim 5, wherein the core has a cylindrical body having a plurality of teeth on an outer surface thereof which form corresponding casting points on an inner surface of the hollow body.

7. The method of claim 1, further comprising arranging a parting point between a middle core and a sealing ring so far to an outside that a residual burr comes within a machining allowance of an unfinished hollow body.

8. A method of producing a hollow body, the method comprising:

providing a die casting machine with a mould that includes a stationary mould plate and movable mould plate having a plurality of movable mould parts which are movable from a centre of the movable mould plate;

moving a core into the mould, the core having a plurality of teeth on an outer surface thereof which form corresponding casting points on an inner surface of the hollow body;

displacing the movable mould parts from the centre of the movable mould plate and closing the mould by pressing the movable mould plate against the stationary mould plate;

pressing a liquid metal into the mould;

moving the movable mould plate into an operating position and then moving the core to the operating position; and removing the hollow body from the mould after moving the core to the operating position.

9. A method of producing a hollow body, the method comprising:

providing a die casting machine with a mould that includes a stationary mould plate and movable mould plate having a plurality of movable mould parts which are movable;

moving a core into the mould, the core having a plurality of teeth on an outer surface thereof which form corresponding casting points on an inner surface of the hollow body;

displacing the movable mould parts from the centre of the movable mould plate and closing the mould by pressing the movable mould plate against the stationary mould plate;

pressing a liquid metal into the mould; and removing the hollow body from the mould after moving the core to an operating position.

* * * * *